US006027069A

United States Patent [19]

Huang

[11] Patent Number: 6,027,069

[45] Date of Patent: Feb. 22, 2000

[54] PLASTIC MEMBRANE DISPENSER

[76] Inventor: Harrison Huang, No. 23, Lin T'So Rd., Shengkang, Taichung Hsien, Taiwan

[21] Appl. No.: 09/037,088

[22] Filed: Mar. 9, 1998

[51] Int. Cl.[7] ..... B65H 75/02

[52] U.S. Cl. ..... 242/588.2

[58] Field of Search ..... 242/588.1, 588.2, 242/588, 405, 405.3, 613.5, 596, 596.7

[56] References Cited

U.S. PATENT DOCUMENTS 4,582,273 4/1986 Saraisky ..... 242/588.1

5,203,517 4/1993 Parry et al. ..... 242/588.2

*Primary Examiner*—John M. Jillions

*Attorney, Agent, or Firm*—Browdy and Neimark

[57] ABSTRACT

A plastic membrane dispenser is composed of a holding member and a pivoting member fastened pivotally with the holding member. The holding member has a cylindrical shaft which is provided at one end thereof with a protruded lip and a recess extending toward another end of the cylindrical shaft. The recess is provided with a retaining surface. The pivoting member has a cylindrical body and an arresting surface. The cylindrical body is provided with a receiving hole dimensioned to receive therein the cylindrical shaft of the holding member.

13 Claims, 3 Drawing Sheets

PLASTIC MEMBRANE DISPENSER

FIELD OF THE INVENTION

The present invention relates generally to a dispenser, and more particularly to a device for dispensing the thin plastic membrane for wrapping a bulky article.

BACKGROUND OF THE INVENTION

Like cellophane which is rolled up and used as a moisture-proof wrapping for food, the thin plastic membrane is rolled up to facilitate the wrapping of goods to protect goods from dust and water. The conventional dispenser for the plastic membrane is complicated in construction and is therefore not cost-effective. In addition, it is difficult to use.

SUMMARY OF THE INVENTION

The primary objective of the present invention is to provide an improved device for dispensing the thin plastic membrane. The dispensing device is simple in construction and easy to use.

In keeping with the principle of the present invention, the foregoing objective of the present invention is attained by a dispenser consisting of a holding member and a rotating member. The holding member has a cylindrical shaft which is provided at one end thereof with a protruded lip and a recess extending toward another end of the cylindrical shaft. The recess is provided with a retaining surface. The rotating member has a cylindrical body for holding the cylindrical shaft, and an arresting surface. The rotating member is rotatably fastened with the holding member.

The foregoing objective, features and functions of the present invention will be more readily understood upon a thoughtful deliberation of the following detailed description of a preferred embodiment of the present invention with reference to the accompanying drawings.

DETAILED DESCRIPTION OF THE INVENTION

As shown in FIGS. 1–5, a dispenser embodied in the present invention is intended to dispense a roll of thin plastic membrane for wrapping a bulky article and is composed of a holding member 10 and a rotating member 20.

Figure 4:
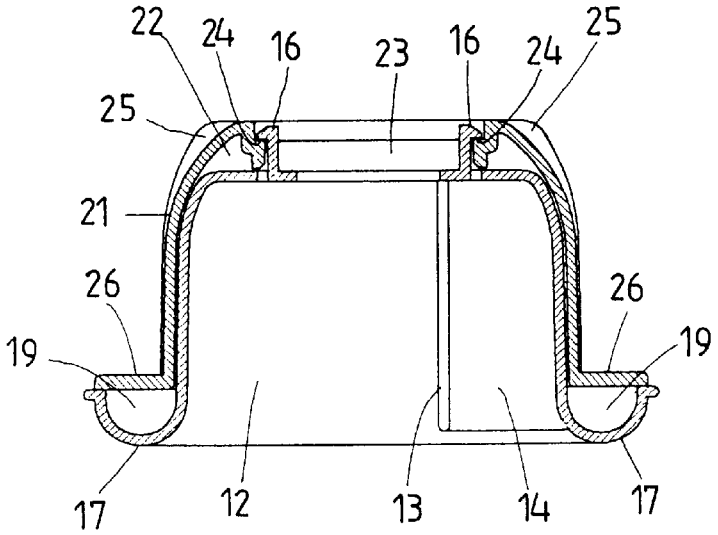
FIG. 4 shows a sectional view of a portion taken along the direction indicated by a line 4—4 as shown in FIG. 3.
Figure 5:
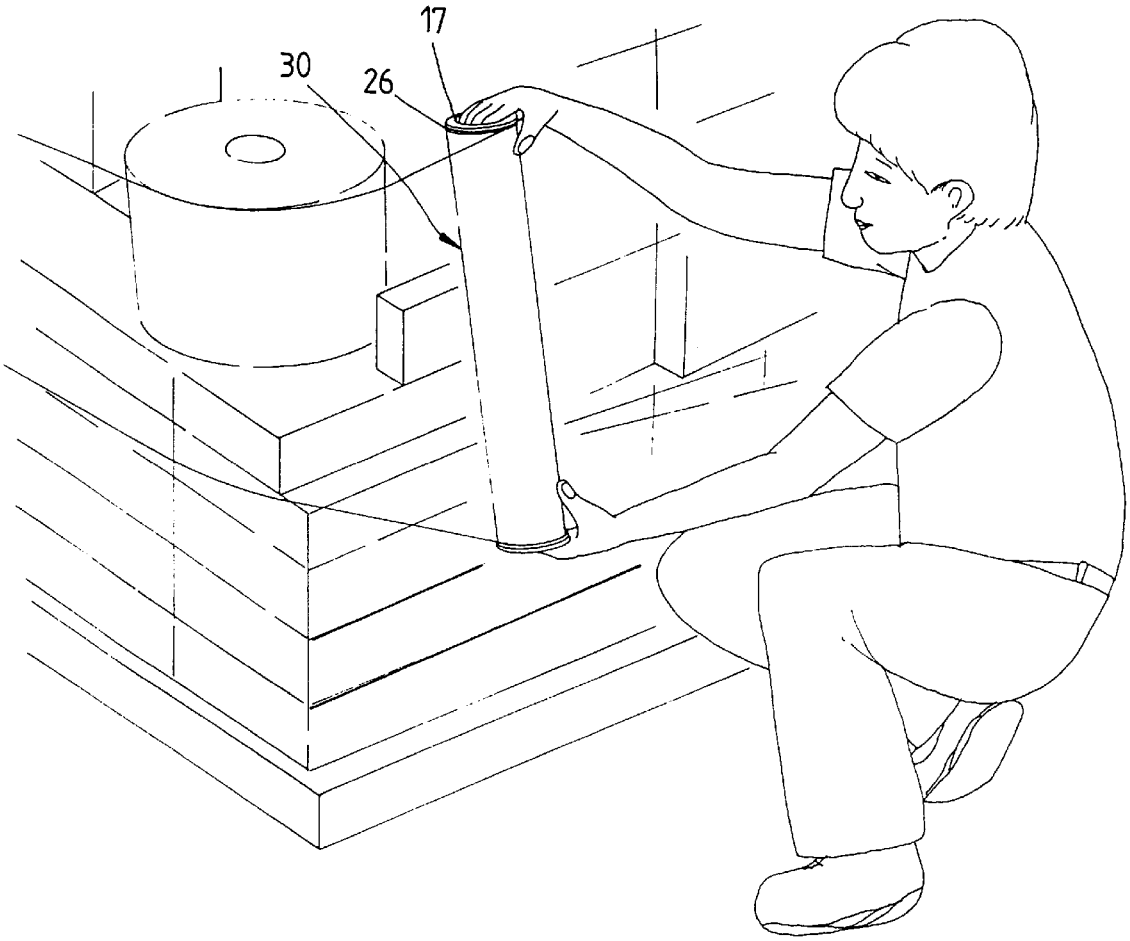
FIG. 5 shows a schematic view of the present invention at work.

The holding member 10 has a cylindrical shaft 11 which is provided at the bottom end thereof with a recess 12 dimensioned to allow entry of four fingers except the thumb. The recess 12 is provided therein with a retaining surface 13 which is corrugated. Located between the retaining surface 13 and the recess 12 are two bracing pieces 14. The cylindrical shaft 11 is provided at the top end thereof with a center hole 15 and two retaining hooks 16 opposite to each other in location. The cylindrical shaft 11 is provided at the bottom edge thereof with a protruded lip 17 extending outwardly and semicircularly, as shown in FIG. 4. The cylindrical shaft 11 is further provided in the top side thereof with a circular slot 18 which is provided with a plurality of reinforcing pieces 19 arranged equidistantly.

The rotating member 20 has a cylindrical body 21 which is provided with a top end of an arcuately tapered construction and a receiving hole 22 with an opening facing downwards. The receiving hole 22 is dimensioned to receive the cylindrical shaft 11. The cylindrical body 21 is provided at the center of the top thereof with a round hole 23 in communication with the receiving hole 22. The round hole 23 is provided in the wall thereof with a retaining shoulder 24. The cylindrical body 21 is further provided in the outer surface thereof with a plurality of ribs 25 arranged equidistantly such that the ribs 25 extend from the edge of the round hole 23 to the bottom edge of the cylindrical body 21. The cylindrical body 21 is further provided on the edge of the bottom end thereof with an arresting circular surface 26 having a radial width smaller than the protruded lip 17 of the holding member 10.

Figure 1:
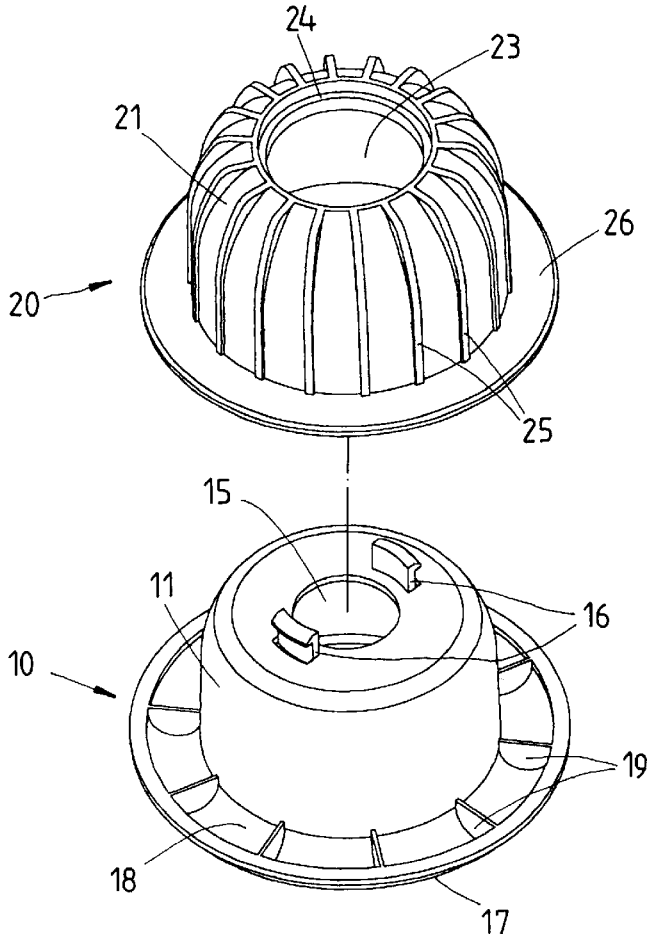
FIG. 1 shows an exploded view of the present invention.
Figure 2:
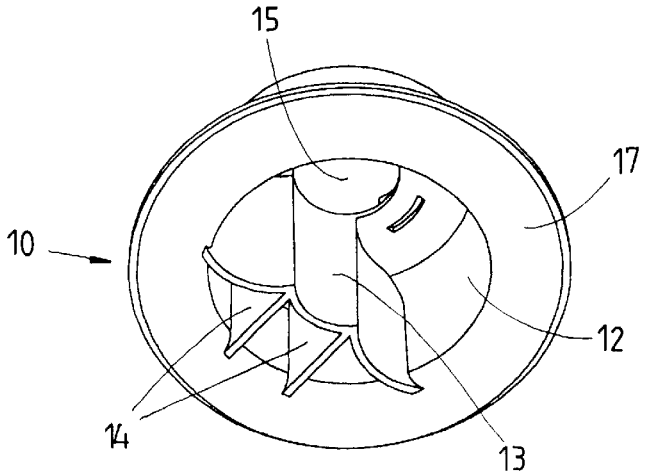
FIG. 2 shows a bottom view of the holding member of the present invention.
Figure 3:
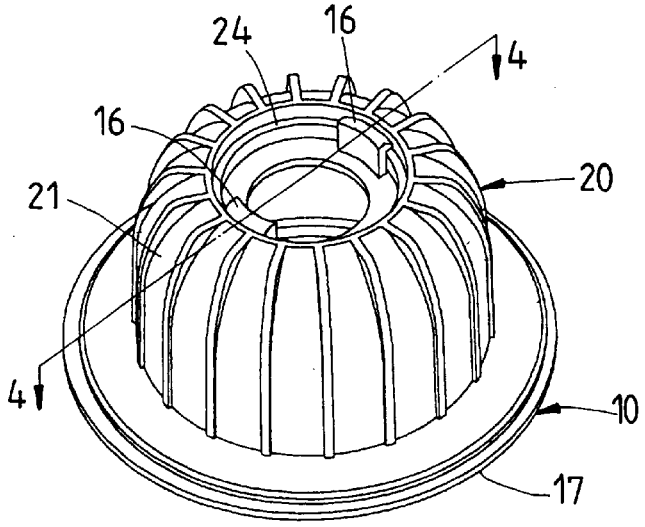
FIG. 3 shows a perspective view of the present invention in combination.

As shown in FIGS. 3 and 4, the cylindrical shaft 11 of the holding member 10 is received in the receiving hole 22 of the pivoting member 20 such that the retaining hooks 16 are engaged with the retaining shoulder 24 of the round hole 23 of the rotating member 20, and that the arresting circular surface 26 of the rotating member 20 is in contact with the protruded lip 17 of the holding member 10. As a result, the holding member 10 and the rotating member 20 are incapable of relative axial displacement and are capable of rotating at the original position thereof.

In operation, both ends of the plastic membrane roll 30 are provided respectively with a dispenser of the present invention such that the cylindrical body 21 of the rotating member 20 is inserted into the hollow tube of the plastic membrane roll 30, and that the arresting circular surface 26 is pressed against the end of the hollow tube, and further that the retaining surfaces 13 of the two dispensers face the same side. With the exception of the thumbs of both hands of an operator, four fingers of both hands of the operator are extended into the recesses 12 such that four fingers hold the retaining surface 13. In dispensing the plastic membrane, the plastic membrane roll 30 turns smoothly. The hands of the operator are protected by the protruded lips 17 of the arresting circular surfaces 26. The plastic membrane can be tightened by pressing the circumference of the plastic membrane roll with thumbs of both hands of the operator.

The present invention can be economically made of a plastic material by injection molding and sold along with the plastic membrane roll. Of course, the present invention may be sold independently.

What is claimed is:

1. A plastic member dispenser comprising:

a holding member having a cylindrical shaft which is provided at first end thereof with a circular protruded lip and a recess extending from said first end toward a second end of said cylindrical shaft, said recess provided therein with a retaining surface spaced apart from a wall of said recess; and a rotating member having a cylindrical body which is provided with a receiving hole for receiving said cylindrical shaft, said receiving hole having an open end which is provided on an edge thereof with an arresting circular surface;

said cylindrical body having a round hole formed by an inner wall having a retaining shoulder;

said cylindrical shaft being provided with two retaining hooks;

wherein said rotating member is rotatably fastened with said holding member when said cylindrical body is inserted into said cylindrical shaft and said two retaining hooks are engaged to said retaining shoulder with said arresting circular surface abutting a full circumference of said protruding lip.

2. The dispenser as defined in claim 1, wherein said retaining surface of said recess of said cylindrical shaft is corrugated, said retaining surface and a wall of said recess being provided therebetween with a plurality of bracing pieces.

3. The dispenser as defined in claim 1, wherein said protruded lip is extended semicircularly toward the second end of said cylindrical shaft from an edge of said cylindrical shaft, said protruded lip provided in a top side thereof with a circular slot having therein a plurality of reinforcing pieces arranged equidistantly.

4. The dispenser as defined in claim 1, wherein said cylindrical body of said rotating member has a tapered shape.

5. The dispenser as defined in claim 1, wherein said cylindrical body is provided in a circumferential surface thereof with a plurality of ribs.

6. A plastic member dispenser comprising:

a holding member having a cylindrical shaft which is provided at first end thereof with a protruded lip and a recess extending from said first end toward a second end of said cylindrical shaft, said recess provided therein with a retaining surface; and a rotating member having a cylindrical body which is provided with a receiving hole for receiving said cylindrical shaft, said receiving hole having an open end which is provided on an edge thereof with an arresting circular surface;

said cylindrical body having a round hole formed by an inner wall having a retaining shoulder;

said cylindrical shaft being provided with two retaining hooks;

wherein said rotating member is rotatably fastened with said holding member when said cylindrical body is inserted into said cylindrical shaft and said two retaining hooks are engaged to said retaining shoulder with said arresting circular surface abutting a full circumference of said protruding lip;

wherein said retaining surface of said recess of said cylindrical shaft is corrugated, said retaining surface and a wall of said recess being provided therebetween with a plurality of bracing pieces.

7. The dispenser as defined in claim 6, wherein said protruded lip is extended semicircularly toward the second end of said cylindrical shaft from an edge of said cylindrical shaft, said protruded lip provided in a top side thereof with a circular slot having therein a plurality of reinforcing pieces arranged equidistantly.

8. The dispenser as defined in claim 6, wherein said cylindrical body of said rotating member has a tapered shape.

9. The dispenser as defined in claim 6, wherein said cylindrical body is provided in a circumferential surface thereof with a plurality of ribs.

10. A plastic member dispenser comprising:

a holding member having a cylindrical shaft which is provided at first end thereof with a protruded lip and a recess extending from said first end toward a second end of said cylindrical shaft, said recess provided therein with a retaining surface; and a rotating member having a cylindrical body which is provided with a receiving hole for receiving said cylindrical shaft, said receiving hole having an open end which is provided on an edge thereof with an arresting circular surface;

said cylindrical body having a round hole formed by an inner wall having a retaining shoulder;

said cylindrical shaft being provided with two retaining hooks;

wherein said rotating member is rotatably fastened with said holding member when said cylindrical body is inserted into said cylindrical shaft and said two retaining hooks are engaged to said retaining shoulder with said arresting circular surface abutting a full circumference of said protruding lip;

wherein said protruded lip is extended semicircularly toward the second end of said cylindrical shaft from an edge of said cylindrical shaft, said protruded lip provided in a top side thereof with a circular slot having therein a plurality of reinforcing pieces arranged equidistantly.

11. The dispenser as defined in claim 10, wherein said retaining surface of said recess of said cylindrical shaft is corrugated, said retaining surface and a wall of said recess being provided therebetween with a plurality of bracing pieces.

12. The dispenser as defined in claim 10, wherein said cylindrical body of said rotating member has a tapered shape.

13. The dispenser as defined in claim 10, wherein said cylindrical body is provided in a circumferential surface thereof with a plurality of ribs.

* * * * *